United States Patent [19]

Irons

[11] 4,329,007

[45] May 11, 1982

[54] MOUNTING OF FILAMENT ASSEMBLIES IN LAMP UNITS

[75] Inventor: Brian P. G. Irons, Solihull, England

[73] Assignee: Lucas Industries Limited, Birmingham, England

[21] Appl. No.: 136,864

[22] Filed: Apr. 3, 1980

[30] Foreign Application Priority Data

Apr. 28, 1979 [GB] United Kingdom ..... 7914841

[51] Int. Cl.[3] ..... H01R 33/46

[52] U.S. Cl. ..... 339/188 R; 339/88 R

[58] Field of Search ..... 339/17 D, 145 T, 188 R, 339/188 C, 188 T, 181 R, 181 C, 189 R, 189 L, 88 R, 88 C; 24/221 R, 221 A

[56] References Cited

U.S. PATENT DOCUMENTS

| | | | |
|---|---|---|---|
| 1,770,724 | 7/1930 | Bamford | 339/181 R |
| 1,790,567 | 1/1931 | Albright | 339/188 R X |
| 2,100,816 | 11/1937 | Purinton | 24/221 A |
| 2,282,360 | 5/1942 | Horrocks | 24/221 R |
| 3,775,731 | 11/1973 | Merkl et al. | 339/188 C X |
| 4,072,385 | 2/1978 | Wallner | 339/88 R |
| 4,099,820 | 7/1978 | Delano | 339/188 R X |

FOREIGN PATENT DOCUMENTS

| | | | |
|---|---|---|---|
| 2206033 | 5/1974 | France . | |
| 1133378 | 11/1968 | United Kingdom | 339/88 R |
| 1239764 | 7/1971 | United Kingdom . | |

*Primary Examiner*—Eugene F. Desmond

*Attorney, Agent, or Firm*—Ladas & Parry

[57] ABSTRACT

A mounting member for a filament assembly comprises a generally planar base portion and a pair of projections integral with the base portion, the projections having cut-outs therein in which are received respectively a pair of mounting lugs on a base of the filament assembly. The projections are deformed from positions in which they are generally co-planar with the base portion and extend into an aperture formed therein, and positions in which they upstand from the base portion and are of helical configuration. In their undeformed positions, the projections overlap one another and are spaced apart transversely of their direction of extent. Thus, the length of the projections is not limited by the size of the aperture, which must accommodate the external cross-section of the filament assembly base therein.

6 Claims, 7 Drawing Figures

FIG. 1.
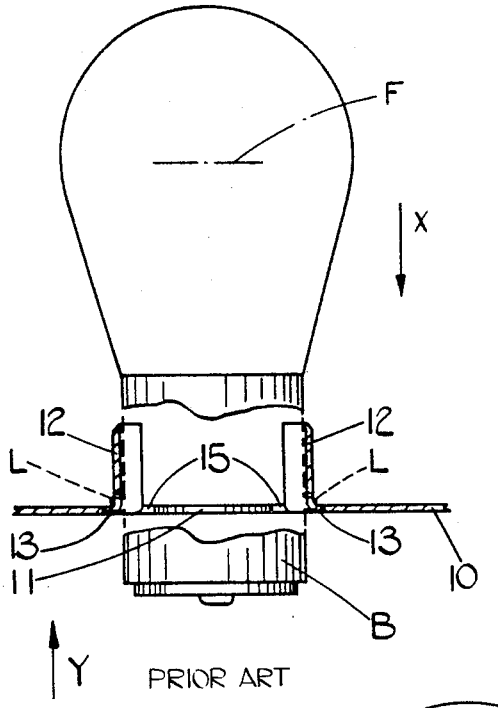
PRIOR ART
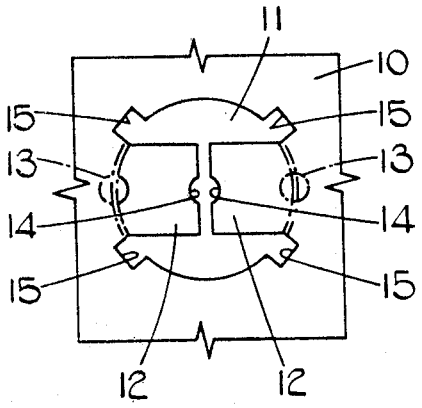
FIG. 2.
PRIOR ART
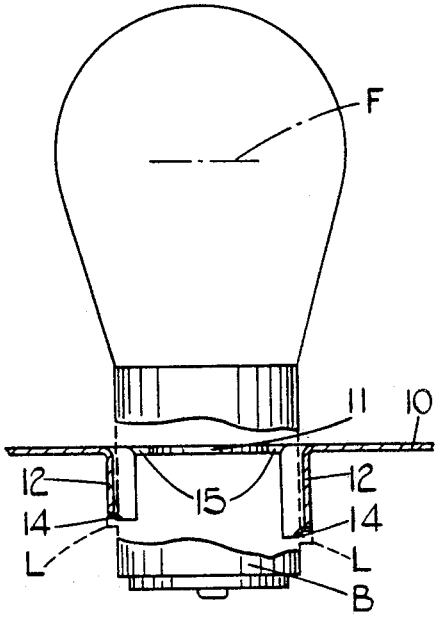
FIG. 3.
PRIOR ART

MOUNTING OF FILAMENT ASSEMBLIES IN LAMP UNITS

This invention relates to a mounting member for a filament assembly, and more particularly to such a mounting member which can be formed from a metal blank by a stamping operation or the like.

According to conventional techniques, mounting members for filament assemblies are often produced by stamping them out from a metal plate or the like. This enables the mounting members to be manufactured quickly and cheaply, and moreover since it is made of metal the mounting member can be used to provide one of the electrical connections to the filament assembly. These conventional techniques are subject to certain disadvantages, as will be described hereafter.

According to one aspect of the present invention, there is provided a mounting member adapted to support a filament assembly having a base and a pair of laterally projecting mounting lugs on said base, said mounting member being made of a deformable material and comprising a generally flat base portion having an aperture therein and a pair of projections which are integral with said base portion and which are deformed from first positions to second positions, said projections in said first positions being generally co-planar with said base portion and extending into the aperture thereof, and being spaced apart transversely of their direction of extent and overlapping one another in said direction, and in said second positions being upstanding from said base portion, said projections being provided with lug-reception means adapted to receive said mounting lugs of said filament assembly, said lug-reception means being spaced from said base portion when said projections are in said second positions.

According to another aspect of the present invention, there is provided a mounting member adapted to support a filament assembly having a base and a pair of laterally projecting mounting lugs on said base, said mounting member being made of a deformable material and comprising a generally flat base portion and a pair of projections which are integral with said base portion and which are deformed from first positions to second positions, said projections in said first positions being generally co-planar with said base portion and being spaced apart transversely of their direction of extent and in said second positions being upstanding from said base portion, said projections being provided with lug-reception means adapted to receive said mounting lugs of said filament assembly, said lug-reception means being spaced from said base portion when said projections are in said second positions and comprising a cut-out in each said projection when said projections are in said first positions.

When the lug-reception means comprises a respective cut-out in each projection adapted to receive a respective one of said mounting lugs, the cut-outs can be of unequal depth so that the mounting member can accommodate a filament assembly whose mounting lugs are mutually staggered along the length thereof.

Preferably, each projection in its deformed position is inclined to the perpendicular to the base portion, and is most preferably of helical configuration.

Advantageously, each projection in its deformed position is so shaped as to follow the external cross-sectional shape of a base of the filament assembly on which said mounting lugs are provided.

For a better understanding of the invention, and to show how the same may be carried into effect, reference will now be made, by way of example, to the accompanying drawings, in which:

FIG. 1 is a sectional side view of a first form of conventional mounting member;

FIG. 2 is a plan view of a metal blank from which the mounting member shown in FIG. 1 is produced;

FIG. 3 is a sectional side view of a second form of conventional mounting member;

Figure 4:
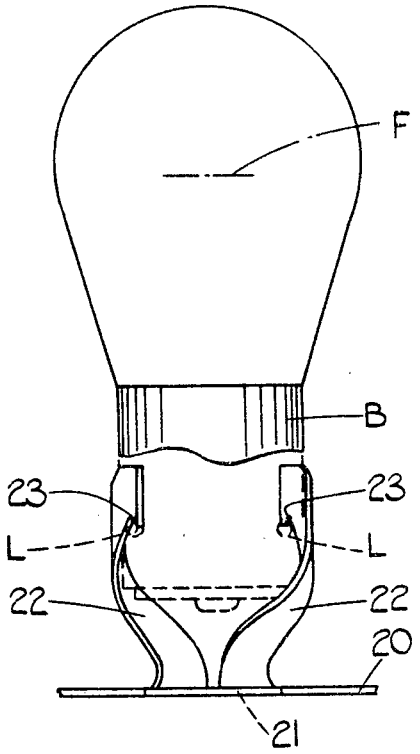
FIG. 4 is a side view of a first embodiment of a mounting member according to the present invention.

Referring first to FIGS. 1 and 2, the mounting member comprises a generally flat base portion 10 having a circular aperture 11 therein. A pair of projections 12 are formed integrally with the base portion 10 and are deformed from positions (shown in full lines in FIG. 2) in which they extend into the aperture 11 and are generally co-planar with the base portion 10 into positions (shown in full lines in FIG. 1 and in chain-dotted lines in FIG. 2) in which they stand up from the base portion 10 and are curved as viewed in plan. Each projection 12 is formed with a small aperture 13 (shown in broken lines in FIG. 2) at its point of connection to the base portion 10 and/or a recess 14 in its free end. As can be seen in FIG. 2, in their undeformed positions the projections 12 have their free ends in mutual facing relation.

The mounting member described above is designed to mount an electric light bulb of the type having a pair of mounting lugs or pins L (shown in broken lines) on an electrically conductive base B thereof, and can mount the bulb by means of one of two different methods. In a first of these methods, the bulb is inserted base-first into the aperture 11 in the direction of arrow X in FIG. 1, i.e. from the side of the base portion 10 on which the projections 12 extend. Passage of the mounting lugs L through the aperture 11 is permitted by opposed cut-outs 15 in the periphery of the aperture 11. The bulb is then twisted to bring the mounting lugs L into alignment with the apertures 13, biasing means (not shown) then urging the bulb upwardly as viewed in the figure to engage the lugs L with the apertures 13. This method of mounting is shown in FIG. 1.

In the second method of mounting the bulb is inserted base-first through the aperture 11 from the opposite side of the base portion 10, i.e. in the direction of arrow Y in FIG. 1, the mounting lugs L again being passed through the cut-outs 15. Such insertion is continued until the mounting lugs L clear the free ends of the projections 12, whereupon the bulb can be twisted to engage the lugs L with the recesses 14 in bayonet fashion. Such engagement between the lugs L and recesses 14 is maintained by biasing means which acts on the bulb.

In the above description, it is assumed that the mounting lugs L of the bulb are mutually aligned longitudinally of the base B: consequently, where the second mounting method is employed, the projections 12 are made of equal length. However, by making these projections of unequal length, the mounting member can be used to mount a bulb of the type wherein the mounting lugs L are mutually staggered longitudinally of the base B. Such an arrangement is shown in FIG. 3.

The above-described mounting members, although being economical and simple to manufacture, do suffer from a drawback when used in lamp units where the positioning of the bulb filament F relative to the focus of a reflector is critical. This is because the mounting member is usually secured to the reflector inter alia by means of the base portion 10, and therefore the position of the latter relative to the reflector focus will be well-defined. Accordingly, the positioning of the bulb filament F relative to the reflector focus will depend upon the positioning of the bulb on the mounting member itself. The freedom with which this latter positioning can be chosen is, however, limited for the following reason.

Where the second of the above-described mounting methods is employed, the positioning of the bulb filament relative to the mounting member will be determined essentially by the spacings of the recesses 14 from the base portion 10, i.e. by the lengths of the projections 12. For a given size of aperture 11 (which is determined by the external cross-sectional size of the base of the bulb to be mounted), there is clearly a limitation on the lengths the projections 12 can have since, in their undeformed state, they must both fit within the aperture 11 in end-to-end disposition. It may not therefore be possible to make the projections 12 sufficiently long to ensure proper positioning of the bulb filament relative to the reflector focus. This limitation is particularly manifest in vehicle lamp assemblies of the type which incorporate into a single module a number of lamp units having different functions, for example indicator, reversing, stop and fog lamp units. In such lamp assemblies, the position occupied by the bulb filament often varies greatly from one lamp unit to another, and the amount of this variation may be sufficiently large to prevent the mounting members of all of the lamps from having their base portions 10 in a common plane. This in turn may make it difficult if not impossible for the mounting members of all of the lamp units to be stamped out from a single, common sheet of metal.

The mounting member shown in FIG. 4 is designed to receive a bulb of the type described above in which the mounting lugs L are mutually aligned longitudinally of the bulb base B, and comprises a generally flat base portion 20 having an aperture 21 therein. A pair of projections 22 are formed integrally with the base portion 20 and are deformed from positions (shown in FIG. 5) in which they are generally co-planar with the base portion and extend into the aperture 21 into positions (shown in FIG. 4) in which they are of helical configuration and stand up from the base portion 20. In their undeformed positions, the projections 22 are generally parallel and are spaced apart transversely with respect to their direction of extent, so that they overlap within the aperture 21.

A cut-out 23 is provided in each of the projections 22. In the undeformed positions of the projections, each cut-out 23 is disposed in an edge of its respective projections which faces away from the other projection. In the deformed positions of the projections, the cut-outs 23 are spaced from the base portion 20 and respectively receive in bayonet fashion the mounting lugs L of the bulb, shown in broken lines. Biasing means (not shown) in use urges the bulb upwardly, as viewed in the drawing, thereby maintaining the lugs L in engagement with the cut-outs 23. The helical configuration of the projections 22 ensures that they follow the external cross-sectional shape of the bulb base B, which is circular.

Figure 5:
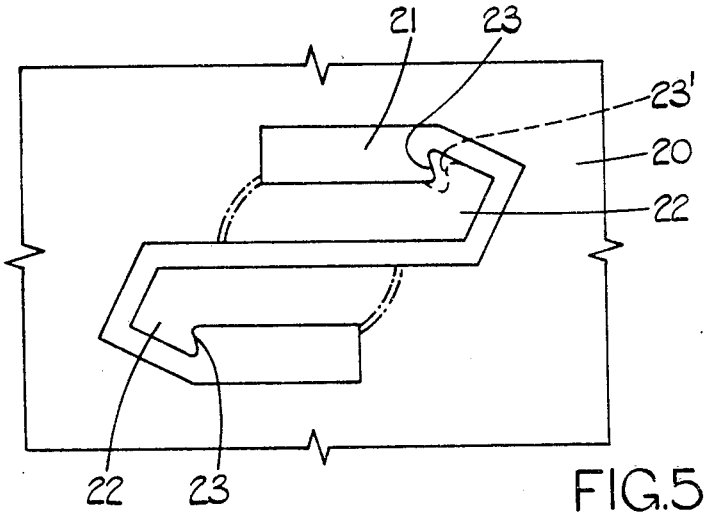
FIG. 5 is a plan view of a metal blank from which the mounting member shown in FIG. 4 is produced.

The mounting member shown in FIG. 4 is produced by performing a plunging and setting operation on the metal blank shown in FIG. 5, this operation causing the above-described deformation of the projections 22. Since the helix angle of the deformed projections 22 is determined by the plunging and setting operation, the final spacings of the cut-outs 23 from the base portion 20 will depend upon the lengths of the projections 22. However, unlike the arrangements described above in relation to FIGS. 1 to 3, the projections 22 in their undeformed states overlap each other in their direction of extent, and their lengths are not therefore limited by having their free ends in mutual facing relation. Moreover, the projections 22 do not have to lie wholly within the confines of the external cross-section of the base B of the bulb to be mounted. The lengths of the projections 22 can therefore effectively be chosen at will to produce a suitable spacing of the cut-outs 23 (and thus a filament F of the bulb) from the plane of the base portion 20. Thus, when the mounting element is incorporated into a lamp unit, the bulb filament F can be positioned accurately relative to a reflector focus. Moreover, in a vehicle lamp assembly of the type mentioned previously, a number of mounting members can be produced from a single, common sheet of metal with the lengths of the projections 22 of each mounting member being suitably chosen having regard to the desired positioning of the respective bulb filament.

Figure 6:
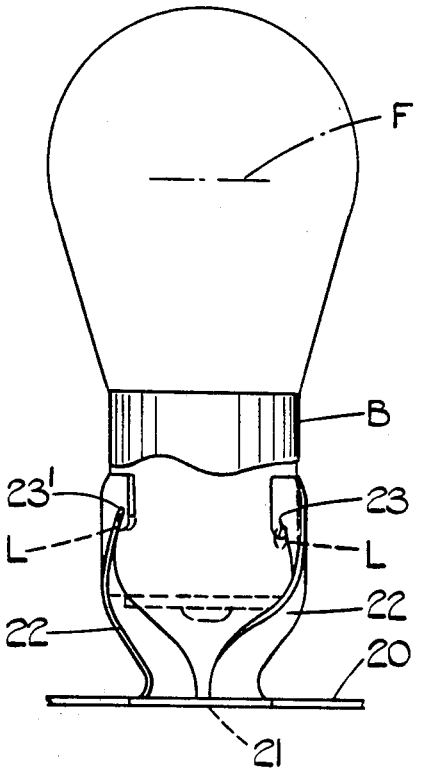
FIG. 6 is a side view of a second embodiment of a mounting member according to the present invention.

FIG. 6 shows a mounting member which is designed to mount a bulb of the type wherein the mounting lugs L are mutually staggered longitudinally of the base B. The mounting member is substantially identical to that described above with reference to FIG. 4, similar parts being accorded the same reference numerals, except that one of the cut-outs is made deeper than the other, as indicated in broken lines at 23' in FIG. 5.

Figure 7:
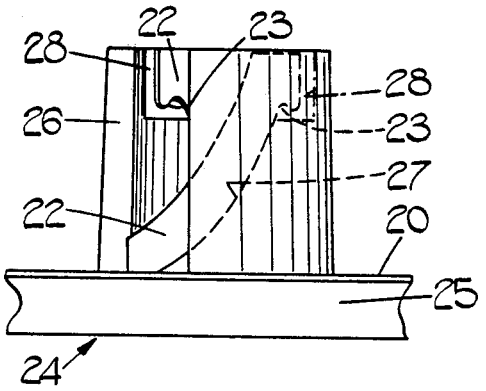
FIG. 7 is a side view of a bulbholder which incorporates a mounting member according to the present invention.

FIG. 7 illustrates a bulbholder which incorporates the mounting member shown in FIG. 4, and which additionally comprises a moulded housing 24. The housing 24 includes a base 25 to which the base portion 20 of the mounting member is secured, and a generally cylindrical hollow body 26 upstanding from the base 25. The body 26 has in its internal surface two helical recesses 27 in which the projections 22 are respectively accommodated. Each recess 27 has an enlarged portion 28 adjacent the cut-out 23 in the respective projection 22, which portion 28 opens onto the top of the body 26. Each recess portion 28 and the associated cut-out 23 co-operate to define a slot for receiving a respective one of the lugs L on the bulb in bayonet fashion.

Where the mounting member is one of a number of such members produced from a common metal sheet, the housing 24 can form part of a larger moulding which incorporates similar housings for the other mounting members. The moulding can also incorporate other features which are usually associated with lamp units.

I claim:

1. A mounting member adapted to support a filament assembly having a base and a pair of laterally projecting mounting lugs on said base, said mounting member being made of a deformable material and comprising a generally flat base portion having an aperture therein and a pair of projections which are integral with said base portion and which are deformed from first positions to second positions, said projections in said first positions being generally co-planar with said base portion and extending into the aperture thereof, and being spaced apart transversely of their direction of extent and overlapping one another in said direction, and in said second positions being upstanding from said base portion, said projections being provided with lug-reception means adapted to receive said mounting lugs of said filament assembly, said lug-reception means being spaced from said base portion when said projections are in said second positions.

2. A mounting member adapted to support a filament assembly having a base and a pair of laterally projecting mounting lugs on said base, said mounting member being made of a deformable material and comprising a generally flat base portion and a pair of projections which are integral with said base portion and which are deformed from first positions to second positions, said projections in said first positions being generally co-planar with said base portion and being spaced apart transversely of their direction of extent and in said second positions being upstanding from said base portion, said projections being provided with lug-reception means adapted to receive said mounting lugs of said filament assembly, said lug-reception means being spaced from said base portion when said projections are in said second positions and comprising a cut-out in each said projection opening onto an edge of said projection which faces away from the other projection when said projections are in said first positions.

3. The mounting member according to claim 2, wherein said mounting lugs are mutually staggered longitudinally of said filament assembly, and the cut-outs in said projections are of unequal depth.

4. The mounting member according to claim 1 or 2, wherein each said projection in said second position is inclined to an imaginary line perpendicular to said base portion.

5. The mounting member according to claim 4, wherein said projections when in said second positions are of helical configuration.

6. The mounting member according to claim 1 or 2, wherein each said projection in said second position is so shaped as to follow the external cross-sectional shape of said base of said filament assembly.

* * * * *